US012029993B1

(12) United States Patent
Chen et al.

(10) Patent No.: US 12,029,993 B1
(45) Date of Patent: Jul. 9, 2024

(54) EGG-SHAPED POP-UP TOY WITH ELECTRONIC EFFECTS

(71) Applicants: 100 Greetings, LLC, Clearwater, FL (US); Jast Company Limited, Kowloon (HK)

(72) Inventors: Jen-Lin Chen, Cupertino, CA (US); Jay Kamhi, Belleair, FL (US)

(73) Assignees: Jast Company Limited, Hong Kong (HK); 100 Greetings, LLC, Clearwater, FL (US)

( * ) Notice: Subject to any disclaimer, the term of this patent is extended or adjusted under 35 U.S.C. 154(b) by 0 days.

(21) Appl. No.: 18/523,780

(22) Filed: Nov. 29, 2023

(30) Foreign Application Priority Data

Oct. 11, 2023 (DE) ..... 20 2023 105 889.2

(51) Int. Cl.

| | |
|---|---|
| ***A63H 13/16*** | (2006.01) |
| ***A63H 3/00*** | (2006.01) |
| ***A63H 5/00*** | (2006.01) |
| ***A63H 33/26*** | (2006.01) |

(52) U.S. Cl.
CPC ..... *A63H 13/16* (2013.01); *A63H 3/006* (2013.01); *A63H 5/00* (2013.01); *A63H 33/26* (2013.01)

(58) Field of Classification Search
CPC ..... A63H 3/006; A63H 5/00; A63H 13/16; A63H 33/26
USPC ..... 446/297, 308, 310
See application file for complete search history.

(56) References Cited

U.S. PATENT DOCUMENTS

| | | | | | |
|---|---|---|---|---|---|
| 608,794 | A * | 8/1898 | Quinn | A63H 13/16 | 446/385 |
| 685,345 | A * | 10/1901 | Perkins et al. | A63H 13/16 | 446/385 |
| 949,544 | A * | 2/1910 | Muehlstein | A63H 13/16 | 446/310 |
| 1,202,301 | A * | 10/1916 | MacKaye | A63H 13/16 | 446/310 |
| 1,567,973 | A * | 12/1925 | Mendelson | A63H 13/16 | 446/198 |
| 1,585,887 | A * | 5/1926 | Beach | A63H 13/16 | 446/310 |
| 2,446,540 | A * | 8/1948 | Leach | A63H 13/16 | 446/310 |
| 2,858,644 | A * | 11/1958 | Derham | A63H 13/16 | 215/316 |

(Continued)

FOREIGN PATENT DOCUMENTS

| | | | | |
|---|---|---|---|---|
| GB | 2274601 | A * | 8/1994 | A63H 13/16 |

*Primary Examiner* — Alexander R Niconovich
(74) *Attorney, Agent, or Firm* — LaMorte + Associates, P.C.

(57) ABSTRACT

A pop-up toy device that has a housing with at least two sections. A spring-loaded post inside the housing operates between a retracted position and an extended position. The spring-loaded post extends a first section of the housing away from a second section of the housing when in its extended position. A groove and rest are formed in the spring-loaded post. A base is mounted in the housing that supports the spring-loaded post. A locking finger extends from the base and follows the groove in the spring-loaded post as the spring-loaded post moves between its retracted position and its extended position. The locking finger engages the rest in the groove and retains the spring-loaded post in its retracted position when said spring-loaded post is manually manipulated into its retracted position from its extended position.

15 Claims, 7 Drawing Sheets

(56) References Cited

U.S. PATENT DOCUMENTS 2,968,121 A * 1/1961 Pearson, Jr. ..... A63H 37/00 403/166
2,990,643 A * 7/1961 Zoeller ..... A45C 1/12 446/9
3,466,792 A * 9/1969 Goldfarb ..... A63H 13/16 446/310
3,471,965 A * 10/1969 Glass ..... A63H 13/16 446/302
3,691,675 A * 9/1972 Rodgers ..... A63H 13/16 446/188
3,797,166 A * 3/1974 Murray ..... A63H 3/48 446/320
4,453,340 A * 6/1984 Kozuka ..... A63H 13/16 446/288
4,626,224 A * 12/1986 Benson ..... A63H 13/00 446/297
4,662,855 A * 5/1987 Morrison ..... A63H 3/48 446/353
4,698,043 A * 10/1987 May ..... A63H 33/005 446/273
6,468,126 B1 * 10/2002 Herber ..... A63H 37/00 472/51
6,544,097 B1 * 4/2003 Bain ..... A63H 3/28 446/302
6,575,807 B2 * 6/2003 Spector ..... A63H 33/00 446/385
6,592,426 B2 * 7/2003 Mesch ..... A63H 33/26 446/175
6,761,612 B1 * 7/2004 Pencil ..... A63H 37/005 446/76
7,862,397 B1 * 1/2011 Ng ..... A63H 29/16 40/411
8,298,036 B2 * 10/2012 Yu ..... A63H 33/22 446/175
8,517,791 B2 * 8/2013 Yamada ..... A63H 33/26 446/129
8,651,322 B2 * 2/2014 Fung ..... G07F 11/44 221/202
9,027,269 B2 * 5/2015 Budzar ..... B42D 15/022 40/124.06
9,108,116 B2 * 8/2015 Swartz ..... A63H 3/50
9,302,528 B2 * 4/2016 Shlonsky ..... B42D 15/022
9,868,073 B2 * 1/2018 Yamada ..... A63H 3/003
9,975,058 B2 * 5/2018 Yamada ..... A63H 11/00
10,449,465 B2 * 10/2019 Hyun ..... A63H 17/26
10,603,597 B1 * 3/2020 Pruzansky ..... A63H 3/008
10,695,687 B2 * 6/2020 Fernandez ..... A63H 33/003
10,987,604 B2 * 4/2021 Yamada ..... A63H 33/26
11,219,839 B2 * 1/2022 Fernandez ..... A63H 33/003
11,395,977 B2 * 7/2022 Pruzansky ..... A63H 33/002
2003/0176146 A1 * 9/2003 Norman ..... A63H 3/18 446/72
2013/0273804 A1 * 10/2013 Rossi ..... A63H 13/16 446/310

* cited by examiner

EGG-SHAPED POP-UP TOY WITH ELECTRONIC EFFECTS

RELATED APPLICATIONS

The Application claims priority of German Patent Application No. 20 2023 105 889.2 filed Oct. 11, 2023.

BACKGROUND OF THE INVENTION

1. Field of the Invention

In general, the present invention relates to pop-up toys that pop open when manually depressed. More particularly, the present invention relates to the structure of the pop-up mechanism used within the toy.

2. Prior Art Description

The market for toys and gimmicks, which are hereinafter collectively referred to as toys, is highly competitive and new ideas are always required to arouse the interest of potential buyers. In addition, there are strong cost pressures, which require new ideas to always be realized as cost-effectively as possible.

It has been found that toys particularly arouse the interest of buyers if they have a function, i.e., if they can be opened and closed, for example, and if built-in light and/or sound effects are triggered when the function is activated.

A large number of such toys are known in the prior art. The task of the present invention is to provide an alternative and at the same time inexpensive toy which has a function and additional light and/or sound effects.

SUMMARY OF THE INVENTION

The present invention is a pop-up toy device that has a housing with at least two sections. A spring-loaded post inside the housing operates between a retracted position and an extended position. The spring-loaded post extends a first section of the housing away from a second section of the housing when in its extended position.

A groove and rest are formed in the spring-loaded post. A base is mounted in the housing that supports the spring-loaded post. A locking finger extends from the base and follows the groove in the spring-loaded post as the spring-loaded post moves between its retracted position and its extended position. The locking finger engages the rest in the groove and retains the spring-loaded post in its retracted position when said spring-loaded post is manually manipulated into its retracted position from its extended position. The locking finger releases the rest and enables the spring-loaded post to spring to its extended position when the spring-loaded post is depressed while already in its retracted position.

As the spring-loaded post moves to its extended position, the spring-loaded post separates sections of the housing and exposes a decorative feature hidden within the housing. Simultaneously, the spring-loaded post activates a circuit board when in its extended position. The circuit board produces audio and/or lights that continue as the decorative feature is exposed.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention pop-up toy device can be embodied in many ways, only one exemplary embodiment of the present is illustrated and described. The exemplary embodiment has been selected in order to set forth one of the best modes contemplated for the invention. The illustrated embodiment, however, is merely exemplary and should not be considered a limitation when interpreting the scope of the appended claims.

Figure 1:
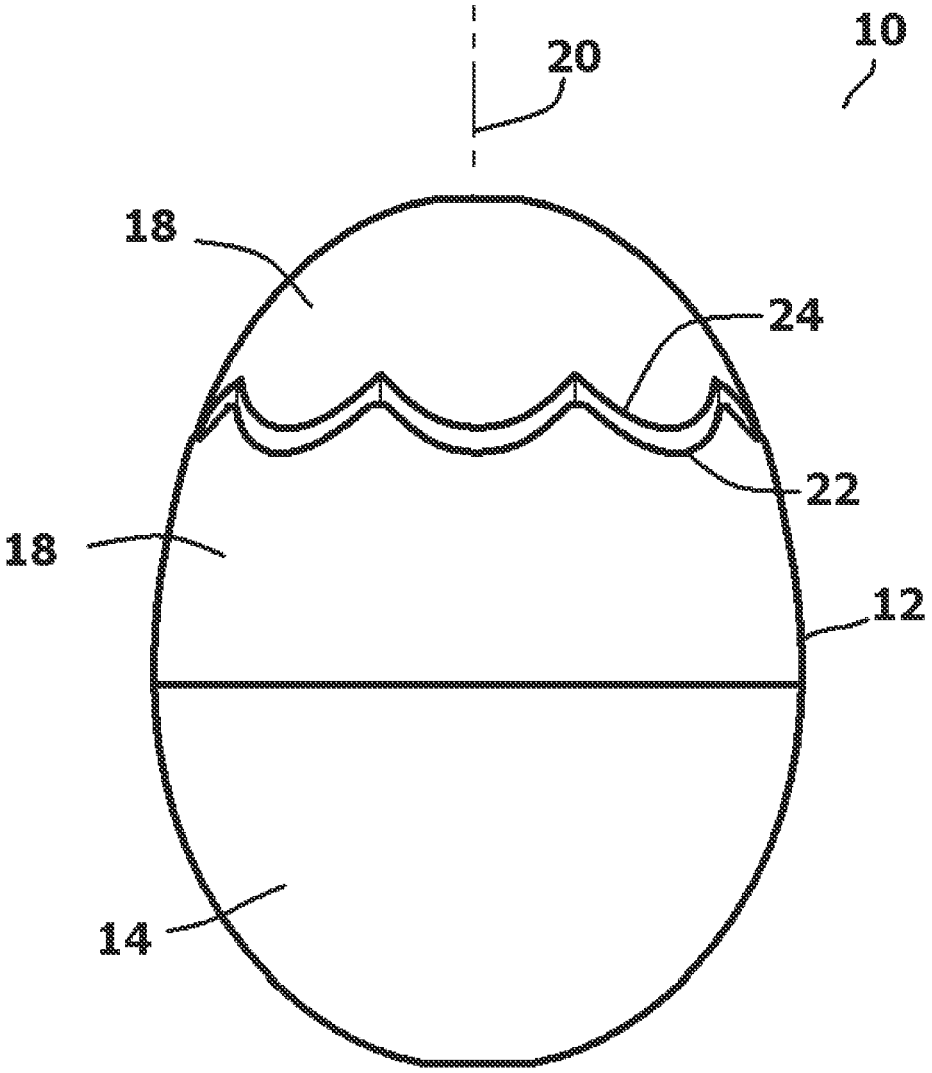
FIG. 1 shows a front view of an exemplary embodiment of a toy pop-up device in a closed configuration.
Figure 2:
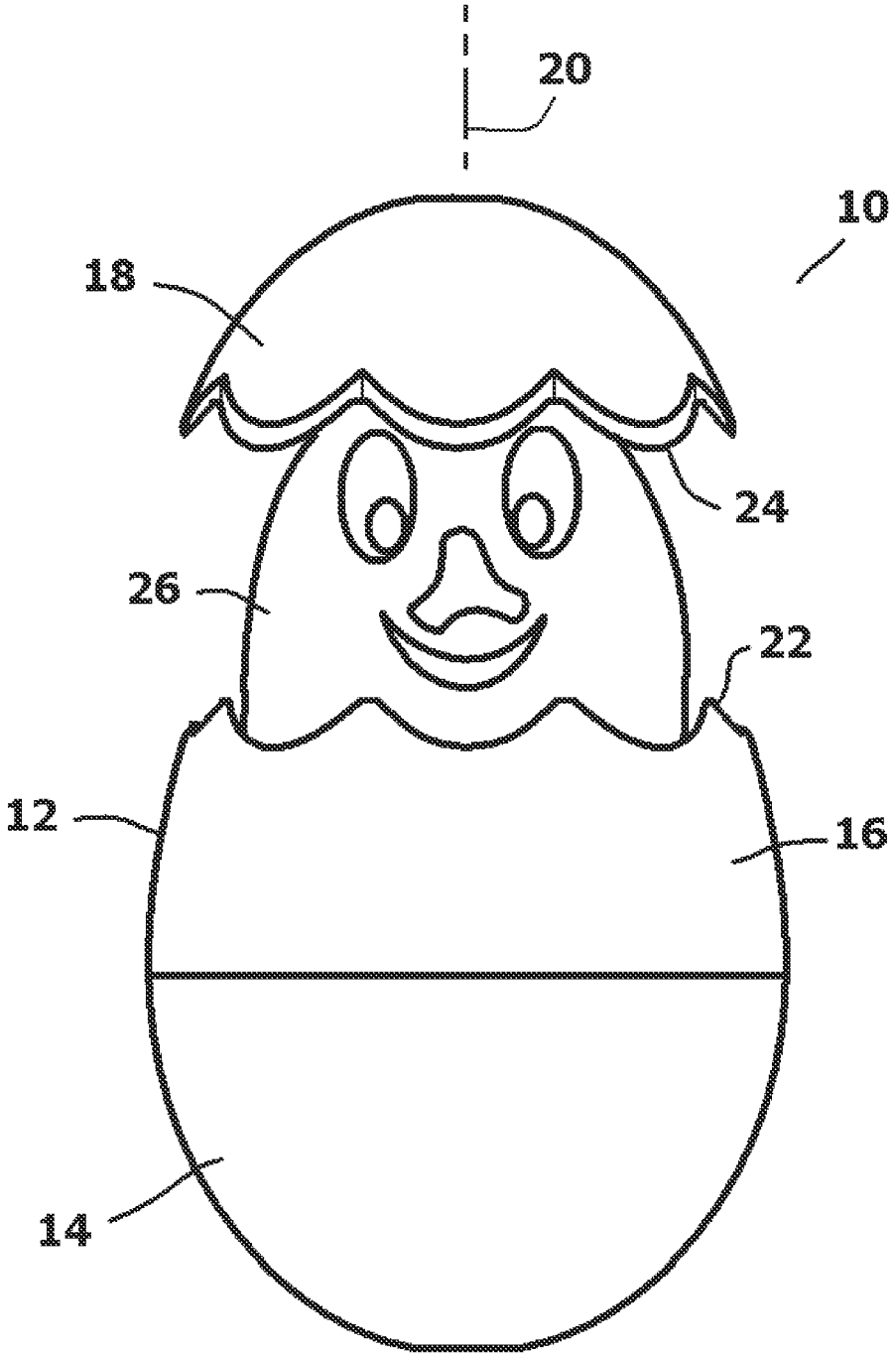
FIG. 2 shows the exemplary embodiment of FIG. 1 in an open configuration.

Referring to FIG. 1 in conjunction with FIG. 2, a pop-up toy device 10 is shown. The pop-up toy device 10 has an outer housing 12 that is generally shaped as an egg. The outer housing 12 is segmented into cladding sections, which include a lower cladding section 14, a center cladding section 16, and an upper cladding section 18. The lower cladding section 14 is rounded and has the general shape of the wide end of an egg. The lower cladding section 14 acts as the base of the pop-up toy device 10 and provides the pop-up toy device 10 with the ability to wobble if pushed off balance. The pop-up toy device 10 has a central vertical axis 20 and a center of gravity that is on the central vertical axis 20 within the confines of the lower cladding section 14. In this manner, the pop-up toy device 10 can bobble about the central vertical axis 20 and come to rest in the vertically aligned configuration of FIG. 1.

The center cladding section 16 is connected to the lower cladding section 14. Accordingly, although shown as two pieces, the lower cladding section 14 and the center cladding section 16 can be formed as a single piece. The center cladding section 16 has an ungulated top rim 22 that provides the general appearance as an edge of a broken egg.

The upper cladding section 18 covers the top rim 22 of the center cladding section 16 and has a lower rim 24 that can intermesh with the top rim 22 of the center section 16. The upper cladding section 18 is rounded and is generally shaped as the small end of an egg.

In FIG. 1, the toy pop-up device 10 is shown in a closed configuration. In the close configuration, the upper cladding section 18 contacts and intermeshes with the center cladding section 16. The center cladding section 16 remains connected to the lower cladding section 14. In FIG. 2, the pop-up toy device 10 is shown in an open configuration. In the open configuration, the upper cladding section 18 is raised above the center cladding section 16. This exposes a decorative feature 26, such as the face of a chick. As such, it will be understood that in the closed configuration, the decorative feature 26 is hidden and in the open configuration, the decorative feature 26 pops up to be exposed to view.

Figure 3:
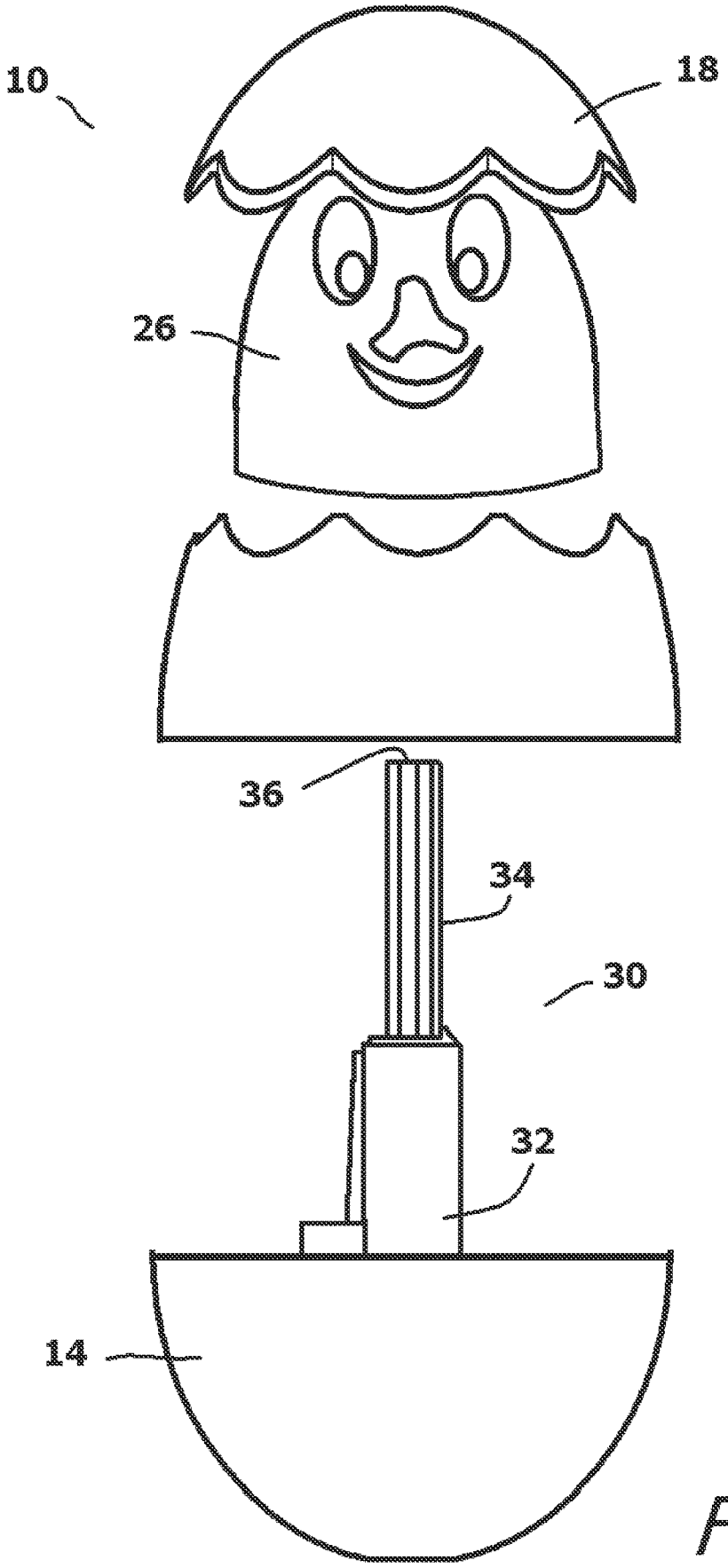
FIG. 3 is a partially exploded view of the exemplary embodiment.
Figure 4:
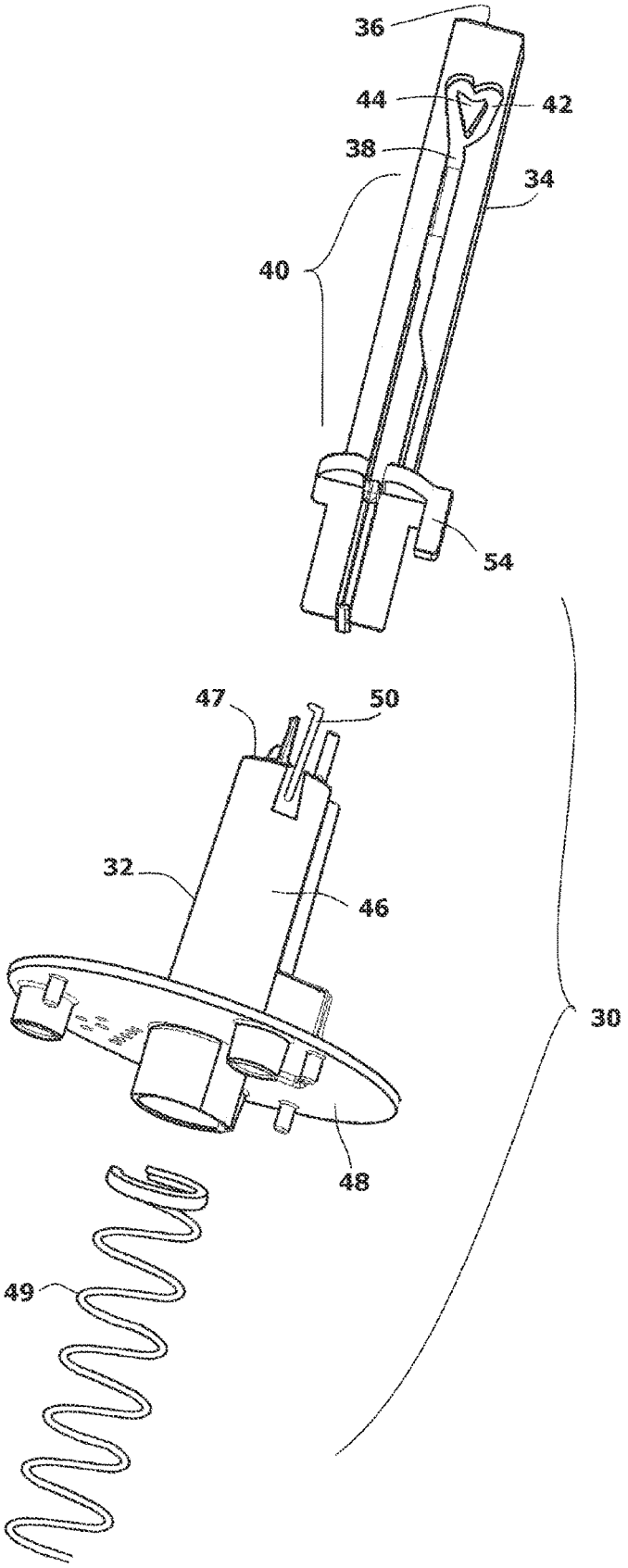
FIG. 4 is an exploded view of the pop-up mechanism used in the exemplary embodiment.

Referring to FIG. 3 and FIG. 4, in conjunction with FIG. 1 and FIG. 2, it can be seen that the pop-up toy device 10 contains an internal pop-up mechanism 30. The pop-up mechanism 30 has a base 32 that is mounted into the lower cladding section 14 of the egg-shaped housing 12. A spring-loaded post 34 extends from the base 32. The spring-loaded post 34 is reciprocally mounted to the base 32. The free end 36 of the spring-loaded post 34 is connected to the decorative feature 26 and the upper cladding section 18. The spring-loaded post 34 is biased into an extended position by a spring 49. The spring-loaded post 34 can be selective locked into a retracted position by depressing the post 34 in opposition of the spring 49. The spring-loaded post 34 can be temporarily locked into its retracted position, as is later described. When the spring-loaded post 34 is in its retracted position, the overall pop-up toy device 10 is in its closed configuration. When the spring-loaded post 34 is extended, the post 34 moves the decorative feature 26 and the upper cladding section 18. This places the overall pop-up toy device 10 into its open configuration.

The base 32 has a tubular element 46 that receives the spring-loaded post 34 and a mounting flange 48 that radially extends from the tubular element 46. The mounting flange 46 is sized to engage the interior of the lower cladding section 14 of the housing 12. The tubular element 46 has a top end 47. A flexible locking finger 50 extends from the top end of the spring-loaded post 34.

Figure 5:
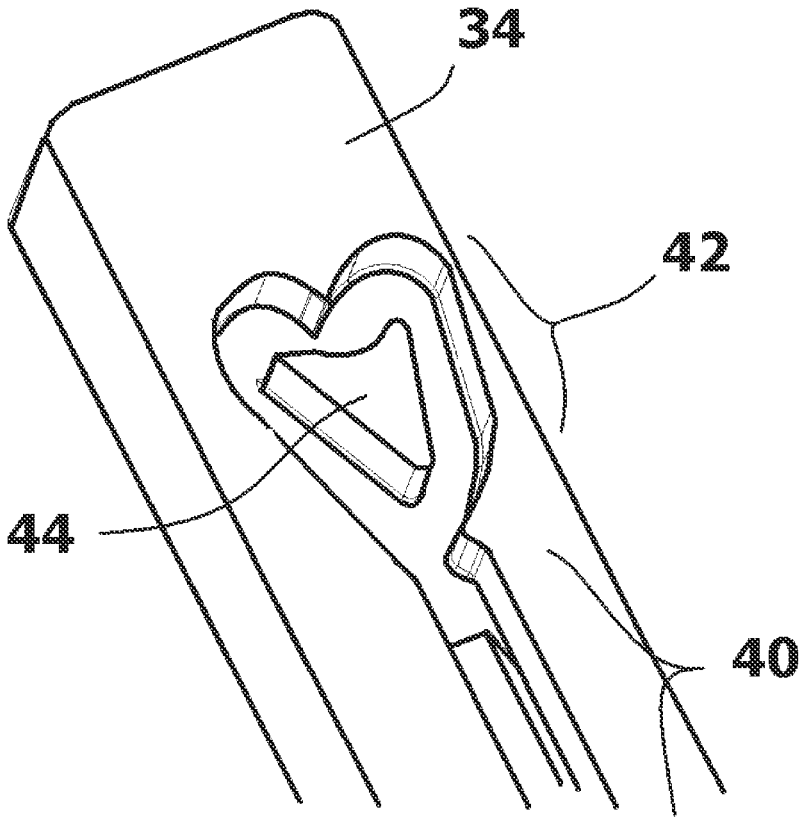
FIG. 5 is a fragmented view of the free end of the spring-loaded post component of the pop-up mechanism.

Referring to FIG. 4 and FIG. 5, it can be seen that the spring-loaded post 34 has a groove 38. The groove 38 has a long straight section 40 and terminated in a looped section 42. A rest 44 is disposed in the loop section 42. The locking finger 50 extending from the top end 47 of the tubular element 46 engages the groove 38 in the spring-loaded post 34. The spring 49 biases the locking finger away from the looped section 42 at the top of the groove 38. The spring-loaded post 34 also has an actuator arm 54. In the shown embodiment, the activator arm 54 is on the side of the spring-loaded post 34. However, it should be understood that the actuator arm 54 can also be located at the bottom of the spring-loaded post 34. The purpose of the activator arm 54 is to contact a switch and activate the electronic features of the pop-up toy device, as is later described.

Figure 7:
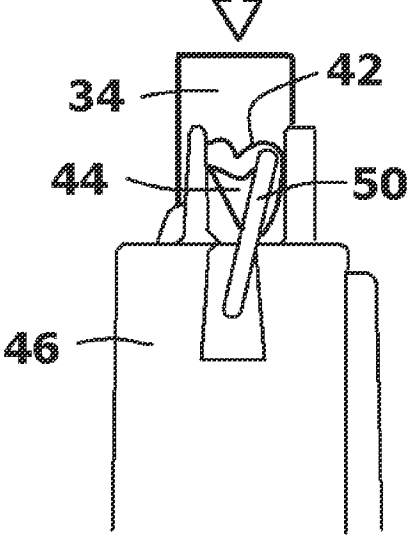
FIG. 7 shows a fragmented view of a locking finger engaging the spring-loaded post when the spring-loaded post is depressed below its retracted position.
Figure 6:
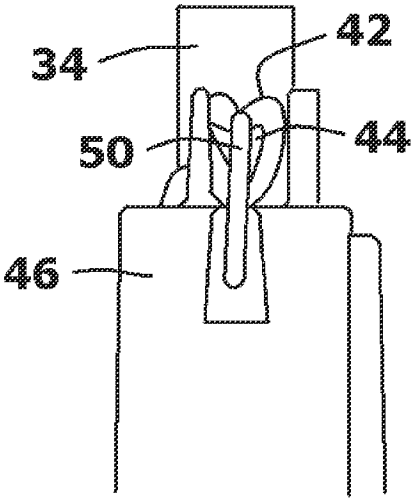
FIG. 6 shows a fragmented view of a locking finger engaging the spring-loaded post when the spring-loaded post is resting in its retracted position.
Figure 8:
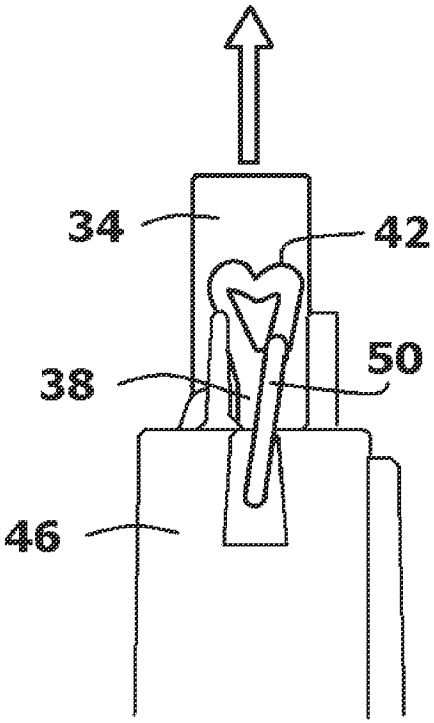
FIG. 8 shows a fragmented view of a locking finger engaging the spring-loaded post after the spring-loaded post is released from the position of FIG. 7; resting in its retracted position.

Referring to FIG. 6, FIG. 7, and FIG. 8 in conjunction with FIG. 4 and FIG. 5, it can be seen that when the spring loaded post 34 is in its retracted position (FIG. 6), the locking finger 50 can engage the rest 44 in the center of the looped section 42. This holds the spring-loaded post 34 in place. When the spring-loaded post 34 is depressed beyond its retracted position, as is shown in FIG. 7, the shape of the loop section 42 directs the locking finger 50 away from the rest 44. Accordingly, when the manual depression is released, as is shown in FIG. 8, the spring-loaded post 34 to return to its extended configuration.

Figure 9:
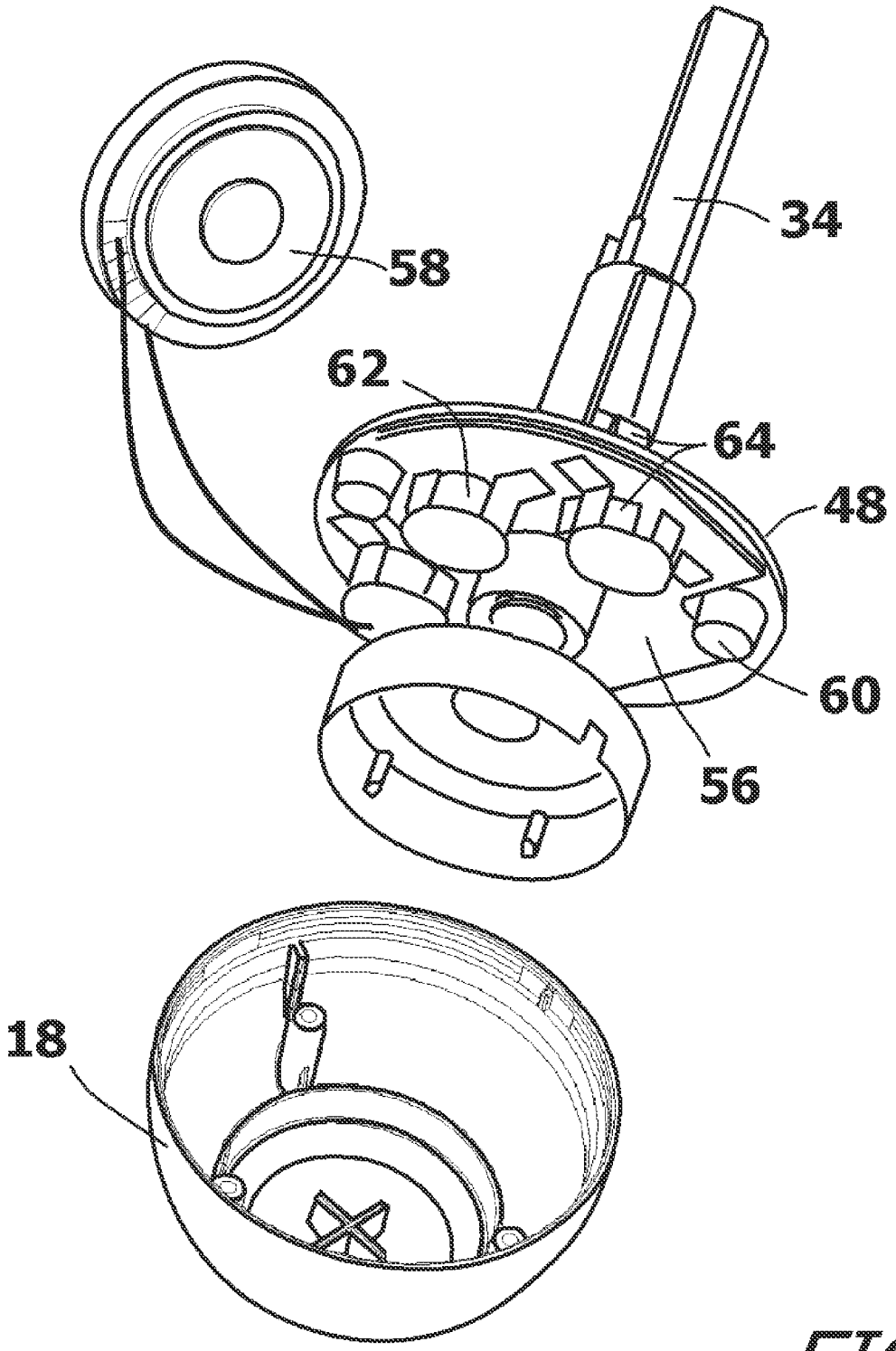
FIG. 9 shows the electronic components of the exemplary embodiment connected to the pop-up mechanism.

Referring to FIG. 9 and FIG. 4, it will be understood that the electronic features of the toy pop-up device 10 are contained on a circuit board 56 that is mounted to the flange 48 of the base 32. The circuit board 56 contains a speaker 58, lights 60, a movement motor 61 and a battery 62. A switch 64 is provided that can be mounted to the circuit board 56 or can be separated from the circuit board 56 by wires. The circuit board 56 contains the circuitry needed to operate the speaker 58, lights 60, and/or movement motor 61 and/or when the switch 64 is activated. The switch 64 is positioned so that the switch 64 is depressed by the activation arm 54 on the spring-loaded post 34. When the spring-loaded post 34 becomes extended, the activation arm 54 disengages the switch 64 and the electronics activate.

Referring now to all figures, it will now be understood that to utilize the toy pop-up device 10, the toy pop-up device 10 is placed on a surface in its closed configuration. The toy pop-up device 10 is egg shaped and is free to wobble. To activate the toy pop-up device 10, the upper cladding section 18 of the housing 12 is manually depressed. This manipulation releases the internal spring-loaded post 34. The spring-loaded post 34 expands and separates the upper cladding section 18 from the remaining housing sections. This exposes the internal decorative feature 26. Simultaneously, the circuit board 56 becomes activated and the toy pop-up device 10 lights up, plays audio, and/or begins to move. Movement is produced by the activation of the movement motor, which can rotate an eccentric weight to cause the overall toy pop-up device to rock or wobble.

It will be understood that the embodiment of the present invention that is illustrated and described is merely exemplary and that a person skilled in the art can make many variations to the embodiment. For instance, the decorative feature can have any appearance as a matter of design choice. All such embodiments are intended to be included within the scope of the present invention as defined by the claims.

What is claimed is:

1. A pop-up toy device, comprising:

an egg-shaped housing having a lower section and an upper section, wherein said lower section has a top rim, and wherein said egg-shaped housing is configurable between a closed configuration and an open configuration, wherein when in said closed configuration said upper section contacts and covers said top rim of said lower section, and when in said open configuration said upper section is completely separated from said lower section, therein exposing all of said top rim;

a spring-loaded mechanism inside said egg-shaped housing, wherein said spring-loaded mechanism has a base, a tubular element that extends from said base, a spring disposed within said tubular element and a post that is biased out of said tubular element by said spring, wherein said base is connected to said lower section and said post is connected to said upper section, wherein said post moves said upper section of said egg-shaped housing relative to said lower section, therein selectively altering said egg-shaped housing between said closed configuration and said open configuration; and a decorative feature inside said egg-shaped housing that becomes visible between said upper section and said lower section when said spring-loaded mechanism moves said egg-shaped housing into said open configuration.

2. The device according to claim 1, further including a circuit board that is activated when said spring-loaded mechanism moves said egg-shaped housing into said open configuration.

3. The device according to claim 2, wherein said circuit board operates a speaker and produces sounds.

4. The device according to claim 2, wherein said circuit board contains lights that light when said circuit board is activated.

5. The device according to claim 1, wherein said said post moves reciprocally relative to said tubular element between an extended position and a retracted position.

6. The device according to claim 5, a wherein said spring biases said post into said extended position.

7. The device according to claim 6, further including a lock that temporarily locks said post in said retracted position, wherein said lock automatically releases said post when said post is manually depressed when in said retracted position.

8. The device according to claim 5, wherein said post has a groove with a rest, and said base supports a locking finger that follows said groove as said post moves between said retracted position and said extended position, wherein said locking finger engages a rest when in said retracted position.

9. The device according to claim 8, wherein said groove guides said locking finger away from said rest when said post is manually moved toward said base when in said retracted position.

10. A pop-up toy device, comprising:

a housing having at least a first section and a second section;

a tubular element, a spring inside said tubular element and post disposed inside said housing, wherein said post rests on said spring inside said tubular element and extends out of said tubular element, wherein said post operates between a retracted position and an extended position by selectively compressing said spring, wherein said post completely separates said first section from said second section when in said extended position, and wherein a groove and rest are formed in said post;

a locking finger that extends from said tubular element, wherein said locking finger extends into said groove and follows said groove as said groove moves between said retracted position and said extended position, and wherein said locking finger engages said rest and retains said post in said retracted position when said post is manually manipulated into said retracted position from said extended position.

11. The device according to claim 10, wherein said groove contains a loop that directs said locking finger away from said rests when said post is depressed while in said retracted position, therein enabling said post to move to said extended position.

12. The device according to claim 10, further including a circuit board that is activated by said post.

13. The device according to claim 12, wherein said circuit board operates a speaker and produces sounds when activated.

14. The device according to claim 13, wherein said circuit board contains lights that light when said circuit board is activated.

15. The device according to claim 10, wherein said housing is egg-shaped.

* * * * *